United States Patent [19]

Sung et al.

[11] Patent Number: 4,581,040

[45] Date of Patent: Apr. 8, 1986

[54] POLYOXYISOPROPYLENEDIAMINE-ACID ANHYDRIDE-POLYAMINE REACTION PRODUCT AND MOTOR FUEL COMPOSITION CONTAINING SAME

[75] Inventors: Rodney L. Sung, Fishkill; Robert H. Jenkins, Jr., Walden, both of N.Y.

[73] Assignee: Texaco Inc., White Plains, N.Y.

[21] Appl. No.: 775,086

[22] Filed: Sep. 12, 1985

[51] Int. Cl.[4] ..... C10L 1/22

[52] U.S. Cl. ..... 44/71; 44/63; 44/72; 252/392

[58] Field of Search ..... 44/63, 71, 72; 252/392; 562/564

[56] References Cited

U.S. PATENT DOCUMENTS

| | | | |
|---|---|---|---|
| 3,455,832 | 7/1969 | Davis | 44/63 |
| 3,920,698 | 11/1975 | Haemmerle et al. | 44/63 |
| 3,980,448 | 9/1976 | Haemmerle et al. | 44/63 |
| 4,419,105 | 12/1983 | Sung | 44/71 |
| 4,477,261 | 10/1984 | Sung | 44/71 |
| 4,536,189 | 8/1985 | Sung | 44/63 |

*Primary Examiner*—Y. Harris-Smith

*Attorney, Agent, or Firm*—Robert A. Kulason; James J. O'Loughlin; Vincent A. Mallare

[57] ABSTRACT

Gasoline of reduced combustion chamber deposit attained by addition of, as additive, a reaction product of polyoxyisopropylenediamine-polyalkylene polyamine-maleic anhydride.

9 Claims, No Drawings

POLYOXYISOPROPYLENEDIAMINE-ACID ANHYDRIDE-POLYAMINE REACTION PRODUCT AND MOTOR FUEL COMPOSITION CONTAINING SAME

BACKGROUND OF THE INVENTION

1. Field of the Invention

This invention relates to hydrocarbon fuels containing additives which reduce the deposit tendency of hydrocarbon fuels. More specifically, this invention discloses motor fuels obtained by the addition of a minor amount of a reaction product of polyoxyisopropylenediamine, maleic anhydride and polyalkylene polyamine.

As automobile manufacturers increase the compression ratio of their automobile engines to obtain higher horsepower, the need becomes greater for gasolines which burn cleanly and have low deposit forming tendencies. Engine deposits which find their origin in the fuel are primarily responsible for surface ignition phenomena such as pre-ignition and octane requirement increase (ORI) which is the tendency of increasing octane requirement during the first several thousand miles of operation. Basically this octane requirement increase is caused by deposits building up in the engine's combustion chambers which can cause engine 'knock' or 'ping'. Formally, knock or ping was stopped by either de-tuning the car's engine or by changing to a higher octane gasoline. The combustion chamber deposits also can cause engine run-on which is the sputter and clatter that is heard sometimes after an engine has been turned off. The present invention seeks to reduce the building up of deposits in an engine's combustion chamber so as to reduce engine knock and run-on and avoid octane requirement increases requiring the switch to a premium grade of gasoline.

2. Information Disclosure Statement

U.S. Pat. No. 4,419,105 discloses the use of the reaction product of maleic anhydride and certain amines or diamines as corrosion inhibitors in alcohols.

U.S. Pat. No. 4,321,062 discloses the use of the reaction product of maleic anhydride, certain phenols, and certain alkyl-alkylene diamines as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and a carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl or alkylene amines as a carburetor detergent, corrosion inhibitor, and anti-icing additive in motor fuels.

SUMMARY OF THE INVENTION

It has now been discovered that the reaction product, i.e., condensate product, of maleic anhydride, a polyoxyisopropylenediamine, and a polyalkylene polyamine has utility as a combustion chamber deposit inhibitor when employed in a motor fuel composition. The novel condensate product of the instant invention is obtained by (i) reacting a dibasic acid anhydride with a polyoxyisopropylenediamine

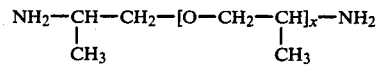

where x has a value of from about 2 to about 50, thereby forming a maleamic acid;

(ii) reacting the maleamic acid with a polyalkylene polyamine

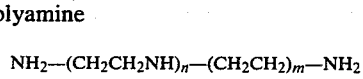

where n has a value of about 0 to about 4 and m has a value of from about 0 to about 2, thereby forming a condensate product; and (iii) recovering the condensate product.

This invention is also directed to a motor fuel composition containing the above described reaction product, i.e., condensate, product which exhibits substantially reduced combustion chamber deposition which in return may reduce ORI.

DETAILED DESCRIPTION OF THE INVENTION

The novel reaction product of this invention is prepared by reacting a dibasic acid anhydride, e.g., maleic anhydride, a polyoxyisopropylenediamine, and a polyalkylene polyamine.

The polyoxyisopropylenediamine reactant is represented by the formula

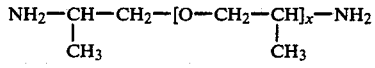

where x has a value of from about 2 to about 50, preferably from about 4 to about 10.

The molecular weight $\overline{M}_n$ of the polyoxyisopropylenediamines may range from about 230 to about 2000. Examples of the polyoxyisopropylenediamine which may be employed herein include those listed below in Table I. These polyoxyisopropylene-diamines are commercially available under the tradename of JEFFAMINE-D which are manufactured by Texaco Chemical Company of Houston, Tex.

TABLE I

| | |
|---|---|
| A. JEFFAMINE D-230 | 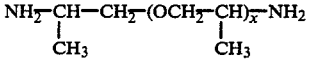 (where x is 2 or 3) |
| B. JEFFAMINE D-400 | 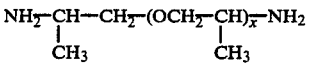 (where x is 5 or 6) |
| C. JEFFAMINE D-2000 | 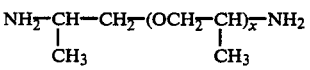 (where x is 33) |

The polyalkylene polyamine reactant is represented by the formula:

$NH_2—(CH_2CH_2NH)_n—(CH_2CH_2)_m—NH_2$ where n is 0 to 4, preferably 1 to 3 and m is 0 to 2, preferably 1.

Examples of polyalkylene polyamines include:

$NH_2—CH_2—CH_2—NH—CH_2—CH_2—NH_2$ $NH_2—CH_2—CH_2—NH—CH_2—CH_2—NH—CH_2CH_2—NH_2$ $NH_2—CH_2—CH_2—NH—CH_2—CH_2—NH—CH_2—CH_2—NH—CH_2—CH_2—NH_2$ $NH_2—CH_2—CH_2—NH—CH_2—CH_2—NH—CH_2—CH_2—NH—CH_2—CH_2—NH_2$

The dibasic acid anhydrides of the present invention, may be represented by the formula

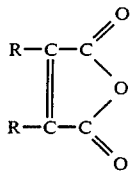

where R is H, $CH_3$— or $C_2H_5$—.

Accordingly, the dibasic acid anhydrides may include the following:

maleic anhydride
alpha-methyl maleic anhydride
alpha-ethyl maleic anhydride
alpha, beta-dimethyl maleic anhydride The preferred dibasic acid anhydride is maleic anhydride.

The reaction product is prepared by first reacting maleic anhydride with the prescribed polyoxyisopropylenediamine. The reaction of 1-2 mole, say 1 mole of maleic anhydride with 1-2 moles, say 1.0 mole of the polyoxyisopropylenediamine is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture. Then, the mixture is cooled to about 60° C. where 1 to 2 moles of a polyalkylene polyamine is added. The mixture with the polyamine is continued to be heated for 2 horus at 100° C. After vacuum stripping the solvent from the mixture, the resulting product is the instant condensate product.

In a preferred method for preparing the reaction product, the 1 mole maleic anhydride and 1 mole polyoxyisopropylenediamine are combined with the solvent xylene and reacted at a temperature of about 100° C. The reaction mixture is maintained at this temperature for approximately 2 hours. The mixture is then cooled to about 60° C., whereupon 1-2 mole, say 1 mole of polyalkylene polyamine is added. The new mixture is then reacted at about 100° C. for approximately 2 hours. The reaction product can then be separated from the solvent using conventional means, or left in admixture with some or all of the solvent to facilitate addition of the reaction product to gasoline or another motor fuel composition. The final reaction product structure (as evidenced by elemental analysis, IR analysis, and NMR analysis) may be represented by the following flow process diagram.

In the process illustrated below, initially, maleic anhydride (A) is reacted with polyoxyisopropylenediamine (B) to form maleamic acid (C). Then, the maleamic acid (C) is reacted with a polyalkylene polyamine (D) to form the condensate product (E) of polyoxyisopropylenediamine, maleic anhydride, and polyalkylene polyamine. Accordingly, the condensate product (E) is recovered.

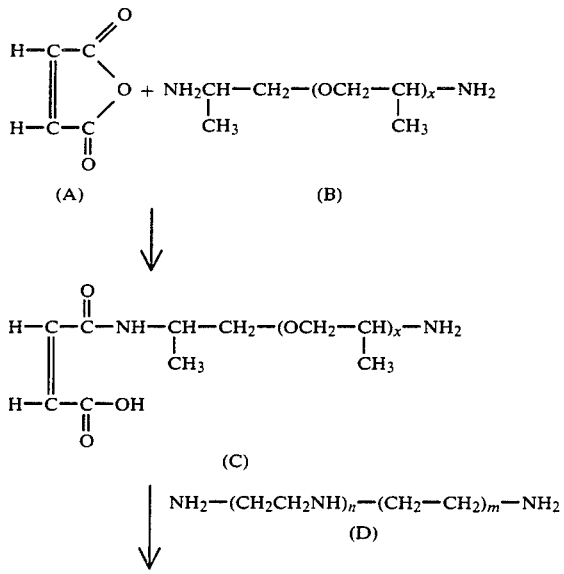

-continued

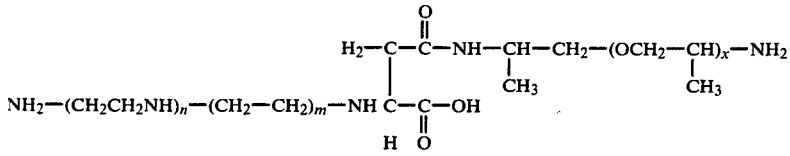

(E)

wherein x is a numeral of about 5.0 and n is about 0 to about 4 and m is about 0 to about 2.

The prepared reaction product, i.e., condensate product may be added to a fuel in a minor deposit-inhibiting amount of about 0.001 to about 0.1 weight percent, and preferably from about 0.01 to about 0.1 weight percent of the reaction product.

The advantages and features of the present invention will be more apparent from the Examples below. The following examples illustrate the preferred method of preparing the reaction product of the instant invention. It will be understood that the following examples are merely illustrative, and are not meant to limit the invention in any way. In the example, all parts are parts by weight unless otherwise specified.

EXAMPLE I

A reaction product was formed by reacting 245 parts of maleic anhydride. 260 parts of xylene, and 102.7 parts of the polyoxyisopropylenediamine JEFFAMINE D-400 at 100° C. for 2 hours. JEFFAMINE D-400 is a polyoxyisopropylenediamine of approximate molecular weight 5.9 having the general formula:

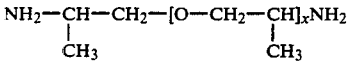

where x has an approximate value of 2 to 50. The mixture was thereafter cooled to about 60° C., and 25.8 parts of diethylene triamine were added. The new mixture was then reacted at about 100° C. for 2 hours to produce the final reaction product. The reaction product was filtered and stripped of the remaining solvent under a vacuum. The final reaction product structure (as evidenced by elemental analysis, IR analysis, and NMR analysis) was as previously described.

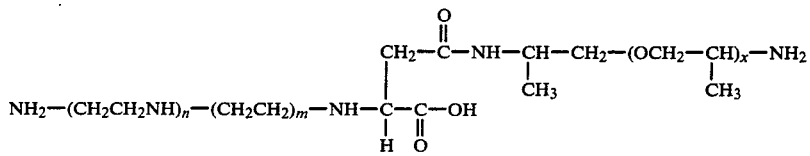

where x has a value from about 20 to 50 depending upon the particular JEFFAMINE D reactant employed, and n has a value from about 0 to 4 and m has a value from about 0 to 2, depending upon the particular polyalkylene polyamine reactant employed.

The combustion chamber deposit controlling agents are provided in the examples below:

In examples II through VII, the same procedure is used as that in Example I except for the amount of polyoxyisopropylenediamine and polyalkylene polyamine. Thus, for each example, the amount of polyether amine and polyalkylene polyamine are provided below with the structure of the condensate product.

EXAMPLE II

Amount of Jeffamine D-400: 410.7 parts
Amount of Diethylene Triamine: 103 parts.

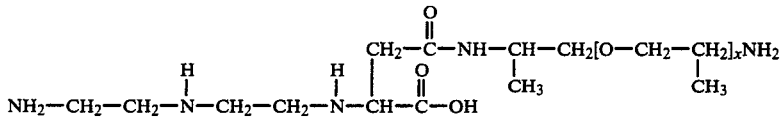

(where x is 5.58)

EXAMPLE III

Amount of Jeffamine D-400: 410.7 parts
Amount of triethylene Tetramine: 145 parts.

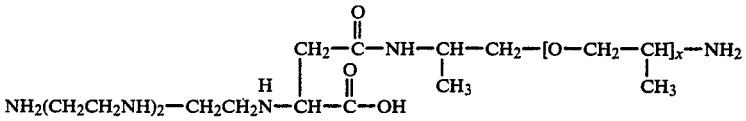

(where x is 5.58)

EXAMPLE IV

Amount of Jeffamine D-230: 114.8 parts
Amount of Diethylene Triamine: 103 parts

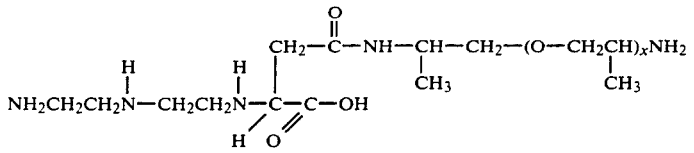

(where x is 2-3)

EXAMPLE V

Amount of Jeffamine D-2000: 1968.4 parts
Amount of Diethylene Triamine: 103 parts

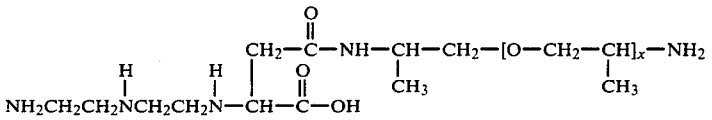

(where x is 33)

EXAMPLE VI

Amount of Jeffamine D-230: 114.8 parts
Amount of Triethylene Tetramine: 145 parts

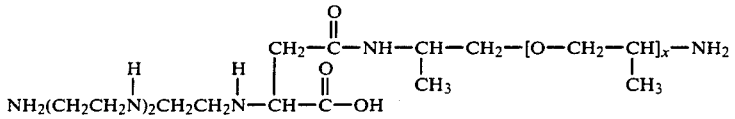

(where x is 2-3)

EXAMPLE VII

Amount of Jeffamine D-200: 1968.4 parts
Amount of Trietylene Tetramine: 145 parts

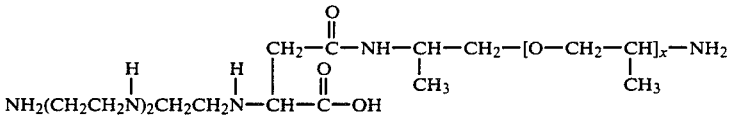

(where x is 33)

The hydrocarbon fuels which may be treated by the process of this invention include liquid hydrocarbon fuels boiling in the gasoline boiling range. Commonly these fuels may be characterized as provided below in Table I.

TABLE I

| Property | Broad | Preferred | Typical |
|---|---|---|---|
| ibp (°F.) | 80-100 | 85-95 | 92 |
| 50% bp (°F.) | 150-300 | 200-250 | 216 |
| 90% bp (°F.) | 300-450 | 330-400 | 334 |
| API Gravity | 50-65 | 55-60 | 61 |

These fuels may be fully formulated gasoline compositions (containing standard commercial additive packages) having a road octane number (RON) of 80-98, preferably 85-95, say 93 and a motor octane number (MON) of 75-95, preferably 80-90, say 83. The fuels may be summer or winter grades, high or low octane, leaded or unleaded, etc. Unleaded gasolines may particularly benefit from practice of this invention.

Illustrative formulations may include those listed below in Table II.

TABLE II

1. A fully formulated unleaded summer grade gasoline (containing a full line of additives) including a hydrocarbon of ibp of 84° F., 50% bp of 218° F., 90% bp of 344° F., and API Gravity of 58.4 containing 100 PTB of the table supra.
2. A fully formulated leaded summer grade gasoline (containing a full line of additives) including a hydrocarbon of ibp of 84° F., 50% bp of 201° F., 90% bp of 343° F., and API Gravity of 61.5 containing 100 PTB of the Example III of the table supra.
3. A fully formulated leaded winter grade gasoline (containing a fully line of additives) including a hydrocarbon of ibp of 80° F., 50% bp of 192° F., 90% bp of 334° F., and API Gravity of 63.8 containing 100 PTB of the Example IV of the table supra.
4. A fully formulated unleaded winter grade gasoline (containing a full line of additive) including a hydrocarbon of ibp of 79° F., 50% bp of 205° F., 90% bp of 336° F. and API Gravity of 61.5 containing 100 PTB of the Example V of the table supra.

It has been found that a motor fuel composition containing the reaction product of the instant invention is effective in minimizing and reducing gasoline internal combustion engine deposit.

This is an improvement in the performance which may reduce the incidence of knock. This invention was tested by the Combustion Chamber Deposit Screening Test (CCDST). In this test, the deposit-forming tendencies of a gasoline are measured; and the amount of deposit correlates with the ORI performance observed in car tests and engine tests. The amount of deposit is compared to a high reference (a standard gasoline known to have a high deposit) and as a low reference (an unleaded base fuel which is known to have a low deposit). Practice of this invention desirably permits attainment of a CCDST rating below that of the low reference.

THE COMBUSTION CHAMBER DEPOSIT SCREEN TEST (CCDST)

The Combustion Chamber Deposit Screening Test (CCDST) determines whether the additive is effective as a deposit control additive to prevent octane requirement increase. In this test, the additive sample is dissolved in unleaded gasoline in a concentration of 100 pounds per thousand barrels (PTB). In a nitrogen/air environment the gasoline is then atomized and sprayed onto a heated aluminum tube. After 100 minutes, the deposits which have formed on the tube are weighed. (Gasolines which form larger amounts of deposits on the heated aluminum tube cause the greatest octane requirement increase (ORI) when employed in an internal combustion engine.

Practice of the process of this invention will be apparent to those skilled in the art from the following wherein, as elsewhere in this description, all parts are parts be weight unless otherwise specified. An asterisk indicates a control example.

In this series of runs, the hydrocarbon fuel is an unleaded base fuel (UBF), containing the instant additive having the properties provided in Table III below.

TABLE III

| Property | Value |
|---|---|
| ibp (°F.) | 92 |
| 50% bp (°F.) | 216 |
| 90% bp (°F.) | 334 |
| API Gravity | 61.0 |
| RON | 93.2 |
| MON | 83.3 |

The gasoline contains 30% aromatics, 17% olefins, and 53% saturates.

In Example I, the reaction product of polyoxyisopropylenediamine, maleic anhydride and diethylene triamine was used at 100 PTB in unleaded gasoline and tested by the Combustion Chamber Deposits Screening Test (CCDST). The amount of deposits formed on the tube after 100 minutes was then determined and reported in milligrams.

Also tested was an example of which is standard gasoline (Example A) known to yield a large deposit as the high reference and a standard unleaded gasoline (Example B) known to yield a low deposit as the low reference. The results were as follows:

TABLE

| Example | Sample of Example | CCDST (mg) |
|---|---|---|
| I | I | 4.8 |
| A | High Reference | 8.3 |
| B | Low Reference | 4.4 |

Preferred motor fuel compositions for use with the reaction product additive set forth by the instant invention are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention.

In addition, the motor fuel composition may contain any of the additives generally employed in gasoline. Thus, the fuel composition can contain anti-knock compounds such as tetraethyl lead compounds, anti-icing additives, upper cylinder lubricating oils, and the like.

It is unexpected and surprising that the reaction product set forth by the instant invention is an effective ORI controlling agent when employed in minor amounts as an additive in motor fuels.

It will be evident that the terms and expressions employed herein are used as terms of description and not of limitation. There is no invention, in the use of these descriptive terms and expressions, of excluding equivalents of the features described and it is recognized that various modifications are possible within the scope of the invention claimed.

We claim:

1. A fuel composition for an internal combustion engine comprising:

(a) a major portion of normally liquid hydrocarbon fuel and (b) a minor amount, as a deposit inhibitor additive, of a condensate product of the process comprising:

(i) reacting a dibasic acid anhydride with a polyoxyisopropylenediamine $$NH_2-\underset{\underset{CH_3}{|}}{CH}-CH_2-(OCH_2\underset{\underset{CH_3}{|}}{CH})_x-NH_2$$

where x is a numeral of about 2 to about 50, thereby forming a maleamic acid;

(ii) reacting said maleamic acid with a polyalkylene polyamine, thereby forming a condensate product and;

(iii) recovering said condensate product.

2. The fuel composition of claim 1, wherein said polyoxyisopropylenediamine has a molecular weight $\overline{M}_n$ ranging from about 230 to about 2000.

3. The fuel composition of claim 1, wherein said polyoxyisopropylenediamine, x is a numeral of about 2 to about 33.

4. The fuel composition of claim 1, wherein said dibasic acid anhydride has the formula

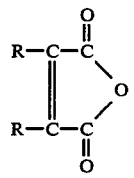

where R is H, $CH_3$— or $C_2H_5$—.

5. The fuel composition of claim 1, wherein said polyamine has the formula $$NH_2-(CH_2CH_2NH)_n-(CH_2CH_2)_m-NH_2$$

where n is a numeral of about 0 to 4 and m is a numeral of about 0 to 2.

6. The fuel composition of claim 1, wherein the minor deposit inhibiting amount ranges from about 0.001 to about 0.01 weight percent of the said reaction product.

7. The fuel composition of claim 6, wherein the minor deposit-inhibiting amount is about 0.01 to about 0.1 weight percent of said reaction product.

8. A fuel composition for an internal combustion engine comprising:

(a) a major portion of a liquid hydrocarbon having a boiling point of 75° to 450° F. and (b) a minor amount, as a deposit-inhibiting additive of a condensate product of the process comprising:

(i) reacting a polyoxyisopropylenediamine

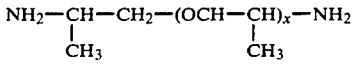

where x is a numeral of about 2 to about 50, with a dibasic acid anhydride

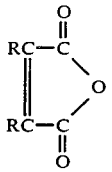

thereby forming a maleamic acid;

(ii) reacting said maleamic acid with a polyalkylene polyamine $NH_2—(CH_2CH_2NH)_n—(CH_2CH_2)_mNH_2$ where n is 0–4 and m is 0 to 2, preferably 1, thereby foring a condensate product

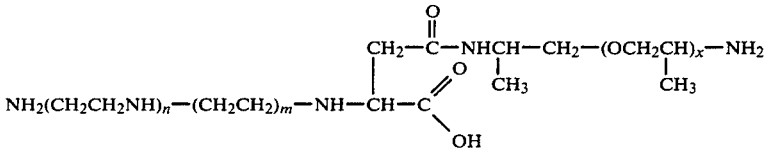

where x is a numeral of about 2 to about 50; n is 0 to 4 and m is 0 to 2; and (iii) recovering said condensate product.

9. A fuel composition for an internal combustion engine comprising:

(a) a major portion of a fuel having a boiling point of 75° to 450° F. and (b) about 0.01 wt.% of a deposit-inhibiting condensate product of the process comprising:

(i) reacting a polyoxyisopropylenediamine

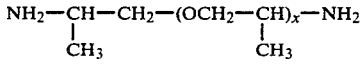

where x is a numeral of about 2 to about 50 with maleic anhydride, thereby forming a maleamic acid

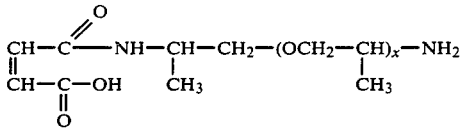

(ii) reacting said maleamic acid with diethylene triamine, thereby forming a condensate product

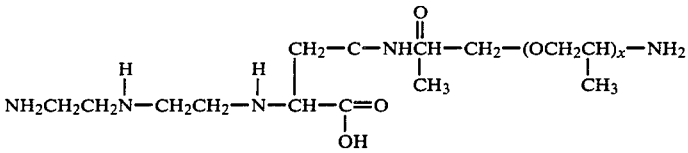

and (iii) recovering said condensate product.

* * * * *